US012745868B2

(12) United States Patent
Allison et al.

(10) Patent No.: US 12,745,868 B2
(45) Date of Patent: Sep. 29, 2026

(54) SHEET ASSEMBLY FOR USE WITH A MATTRESS IN A CORRECTIONAL FACILITY

(71) Applicant: Bob Barker Company, Inc., Fuquay-Varina, NC (US)

(72) Inventors: Gerrad Stephen Allison, Angier, NC (US); Lena Renee Butterfield, Apex, NC (US)

(73) Assignee: BOB BARKER COMPANY, INC., Fuquay-Varina, NC (US)

( * ) Notice: Subject to any disclaimer, the term of this patent is extended or adjusted under 35 U.S.C. 154(b) by 336 days.

(21) Appl. No.: 17/569,755

(22) Filed: Jan. 6, 2022

(65) Prior Publication Data

US 2022/0218128 A1 Jul. 14, 2022

Related U.S. Application Data

(60) Provisional application No. 63/137,351, filed on Jan. 14, 2021.

(51) Int. Cl.
*A47G 9/02* (2006.01)

(52) U.S. Cl.
CPC ..... *A47G 9/0238* (2013.01); *A47G 9/02* (2013.01); *A47G 9/0246* (2013.01)

(58) Field of Classification Search
CPC ..... A47G 9/0238; A47G 9/02; A47G 9/0246; A47G 9/0261; A47G 2009/0269; A47G 2009/0276; A47G 9/0284; A47G 9/0207; A47G 9/0215; A47G 9/0223; A47G 9/023; A47G 9/0253
See application file for complete search history.

(56) References Cited

U.S. PATENT DOCUMENTS

| | | | | |
|---|---|---|---|---|
| 4,137,582 | A * | 2/1979 | Korp | A47G 9/02 5/500 |
| 4,161,044 | A * | 7/1979 | Bogle | A47G 9/02 |
| D477,958 | S * | 8/2003 | Barker | D6/596 |
| 6,804,844 | B2 * | 10/2004 | Cushing | A47C 31/105 5/497 |
| D666,862 | S * | 9/2012 | Edery | D6/602 |
| 8,950,024 | B1 * | 2/2015 | Hudson | A47G 9/02 5/500 |
| 10,398,240 | B2 | 9/2019 | Siebuhr | |
| 2010/0043145 | A1 * | 2/2010 | McCollum | A47G 9/0238 5/490 |
| 2012/0186016 | A1 * | 7/2012 | Martin | A47C 31/11 5/490 |

(Continued)

*Primary Examiner* — Justin C Mikowski
*Assistant Examiner* — Deborah Talitha Gedeon
(74) *Attorney, Agent, or Firm* — COATS & BENNETT, PLLC

(57) ABSTRACT

A sheet assembly for use with a mattress in a correctional institution. The sheet assembly includes a mattress section with a pair of overlapping sheets that are connected together along at least two sides and that form an interior space sized to contain the mattress and a cover section that includes a single sheet. A seam extends along a common side of each of the mattress section and the cover section with the seam connecting together the mattress section and the cover section. The cover section is movable relative to the mattress section between an open orientation away from the mattress section and a closed orientation that overlaps with the mattress section.

18 Claims, 9 Drawing Sheets

(56) References Cited

U.S. PATENT DOCUMENTS

| | | | | |
|---|---|---|---|---|
| 2016/0100700 | A1* | 4/2016 | Dunwood | A47G 9/02 5/496 |
| 2017/0112292 | A1* | 4/2017 | Sopher | A47C 21/028 |
| 2019/0082866 | A1* | 3/2019 | Merchant | A47G 9/0246 |

* cited by examiner

SHEET ASSEMBLY FOR USE WITH A MATTRESS IN A CORRECTIONAL FACILITY

RELATED APPLICATIONS

This application claims priority to U.S. Provisional Application No. 63/137,351, filed Jan. 14, 2021, the disclosure of which is incorporated by reference herein in its entirety.

BACKGROUND

Correctional facilities such as but not limited to prisons, jails, mental health facilities, and detention centers, provide beds for persons housed at the facility. The beds generally include a mattress and one or more sheets. The sheets can be used to cover the mattress for the person to lie on, as well as to cover the person to keep them warm while sleeping.

An issue for correctional facilities is that a person can use a sheet as a weapon to hurt themselves or others. One method is for a sheet to be used as a rope. This can include twisting or otherwise bunching the sheet into an elongated shape that can be tied around the neck and used to hang a person. This is an unfortunately common occurrence for persons to commit suicide while housed within a correctional facility.

There is a need for a sheet assembly that can function to cover the mattress and the user. The design should prevent or reduce the ability of a person to transform the sheet into a weapon, such as a rope, that can be used to hurt themselves or another.

SUMMARY

One aspect is directed to a sheet assembly for use with a mattress in a correctional institution. The sheet assembly comprises: a mattress section comprising a pair of overlapping sheets that are connected together along at least two sides and that form an interior space sized to contain the mattress; a cover section comprising a single sheet; and a seam that extends along a common side of each of the mattress section and the cover section with the seam connecting together the mattress section and the cover section. The cover section is movable relative to the mattress section between an open orientation away from the mattress section and a closed orientation that overlaps with the mattress section.

In another aspect, the mattress section comprises a single member that is folded and that forms the pair of overlapping sheets.

In another aspect, the single member comprises a fold edge that extends along a first lateral side of the mattress section and a pair of exposed ends that extend along an opposing second lateral side of the mattress section and that are secured together at the seam.

In another aspect, the single member further comprises first and second ends that extend between the first and second lateral sides with the first and second ends comprising openings that are in communication with the interior space.

In another aspect, the cover section comprises a greater length than the mattress section.

In another aspect, the overlapping sheets of the mattress section are connected together along first and second lateral sides and one end side with the seam.

In another aspect, the mattress section is constructed from different material than the cover section.

In another aspect, the seam is a first seam and further comprising a second seam that connects together one end of the mattress section.

In another aspect, openings are at two of the sides of the mattress section with the openings in communication with the interior space.

One aspect is directed to a sheet assembly for use with a mattress in a correctional institution. The sheet assembly comprises a top mattress sheet and a bottom mattress sheet that are connected together in an overlapping arrangement and that form an interior space sized to receive the mattress with each of the top and bottom mattress sheets comprising first and second lateral sides and first and second ends. A cover sheet is attached to each of the top mattress sheet and the bottom mattress sheet along the first lateral side.

In another aspect, the top mattress sheet and the bottom mattress sheet are constructed from a single sheet and comprise a fold line along the second lateral side.

In another aspect, openings are positioned between each of the first and second ends of the top and bottom mattress sheets with the openings in communication with the interior space.

In another aspect, the cover sheet comprises a greater length than each of the top and bottom mattress sheets.

In another aspect, the second ends of each of the top and bottom mattress sheets are connected together.

In another aspect, each of the top and bottom mattress sheets and the cover sheet comprise rectangular shapes.

In another aspect, the top and bottom mattress sheets and the cover sheet are connected together along the first lateral sides with a single seam.

One aspect is directed to a method of using a sheet assembly with a mattress in a correctional institution. The sheet assembly comprises a top mattress sheet and a bottom mattress sheet that are connected together in an overlapping arrangement and that form an interior space and a cover sheet that is attached to each of the top mattress sheet and the bottom mattress sheet along a first lateral side. The method comprises: inserting the mattress into an opening formed between the top and bottom mattress sheets; positioning the top mattress sheet along one face of the mattress and the bottom mattress sheet along an opposing second face of the mattress; aligning a seam that attaches the cover sheet to the top and bottom mattress sheets along an edge of the mattress that is positioned between the faces; and selectively positioning the cover sheet in an open orientation that is away from the mattress in a non-overlapping arrangement and a closed orientation that overlaps the mattress.

In another aspect, the method further comprises positioning the mattress into the interior space with the mattress completely within the interior space.

In another aspect, the method further comprises positioning the cover sheet in the closed orientation with an edge of the cover sheet extending outward beyond ends of the top and bottom mattress sheets.

In another aspect, the method further comprises positioning a folded edge of the top and bottom mattress sheets along the mattress and away from the cover sheet.

One aspect is directed to a sheet assembly for use with a mattress in a correctional institution. The sheet assembly comprises: a mattress section comprising a pair of overlapping sheets connected together and forming a cavity sized to contain the mattress; a cover section comprising a single sheet; and a seam that extends along a common side of each of the mattress section and the cover section to connect the sections together. The cover section is movable between an open orientation away from the mattress section and a closed orientation that overlaps with the cover section.

In another aspect, the overlapping sheets of the mattress section are connected along three sides.

In another aspect, the mattress section is constructed from different material than the cover section.

One aspect is directed to a sheet assembly for use with a mattress in a correctional institution. The sheet assembly comprises: a top mattress sheet; a bottom mattress sheet that overlaps with and connects along three sides to the top mattress sheet; and a cover sheet attached to each of the top mattress sheet and a bottom mattress sheet along one of the three sides. The top mattress sheet and the bottom mattress sheet form a cavity that receives the mattress.

In another aspect, the top mattress sheet and the bottom mattress sheet are constructed from a single sheet having a folded configuration.

One aspect is directed to a sheet assembly for use with a mattress in a correctional institution. The sheet assembly comprises: rectangular top and bottom mattresses sheets that are aligned in an overlapping configuration; a rectangular cover sheet; and a seam that extends along one edge of each of the top and bottom mattress sheets and the cover sheet and that attaches the sheets together.

In another aspect, the top and bottom mattress sheets are a single sheet that is folded in an overlapping configuration to form the top and bottom mattress sheets.

One aspect is directed to a sheet assembly for use with a mattress in a correctional institution. The sheet assembly comprises: a cavity formed between top and bottom mattress sheets with the cavity comprising a single opening; and a rectangular cover sheet connected to each of the top and bottom mattress sheets along one common edge.

One aspect is directed to a method of using a sheet assembly with a mattress in a correctional institution. The method comprises: inserting the mattress into an opening in a mattress section and positioning a top mattress sheet along one face of the mattress and a bottom mattress sheet along an opposing second face of the mattress; aligning a seam along an edge of the mattress that is positioned between the faces; positioning a cover sheet that is attached to the mattress section at the seam in an open orientation that is away from the mattress in a non-overlapping arrangement; and positioning the cover sheet in a closed orientation that overlaps the mattress.

The features, functions and advantages that have been discussed can be achieved independently in various aspects or may be combined in yet other aspects further details of which can be seen with reference to the following description and the drawings.

DETAILED DESCRIPTION

Figure 1:
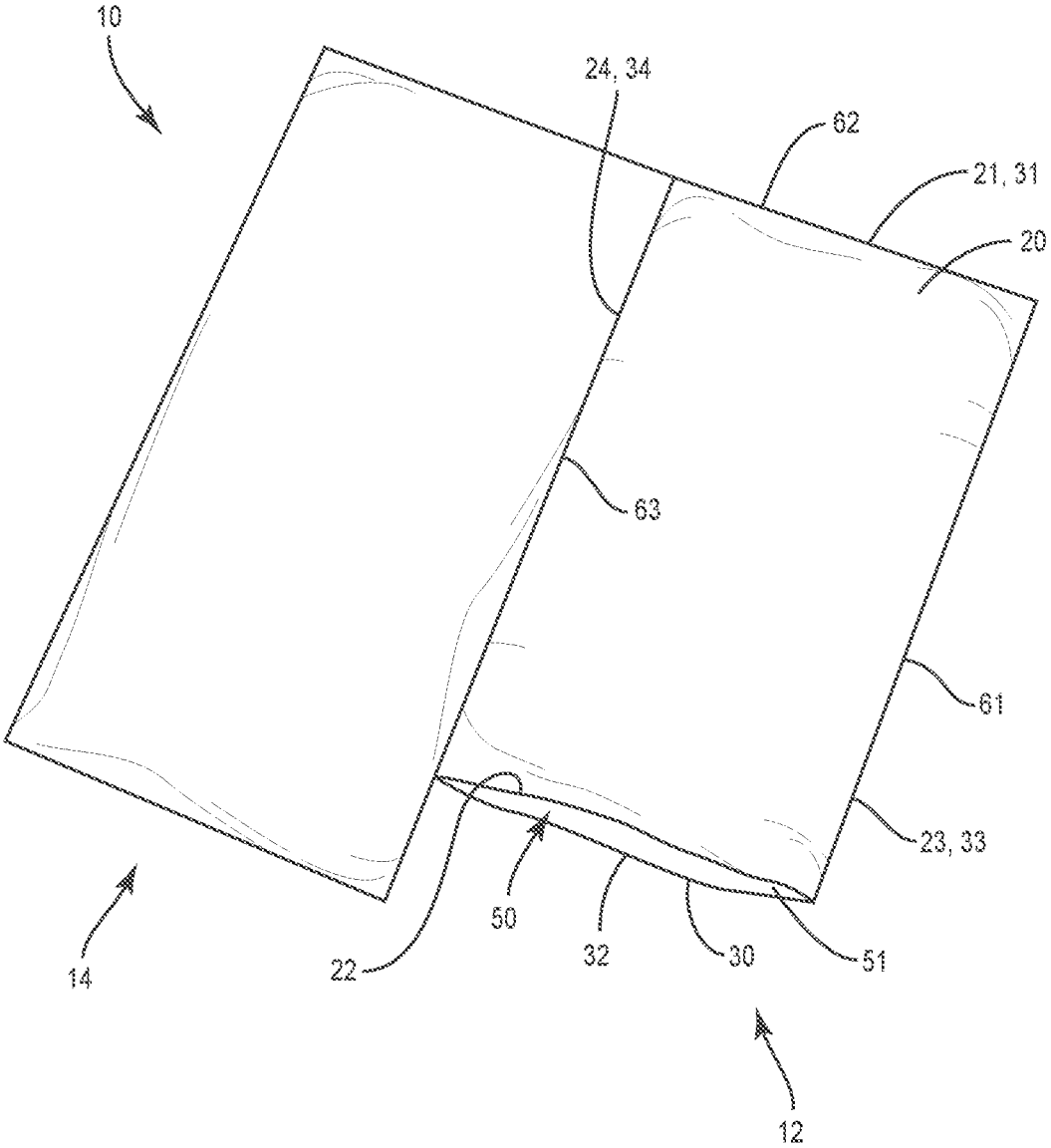
FIG. 1 schematic diagram of a sheet assembly in an open orientation.

FIG. 1 schematically illustrates a sheet assembly 10 for use in a correctional facility. The sheet assembly 10 includes a mattress section 12 and a cover section 14. The mattress section 12 includes a top mattress sheet 20 and a bottom mattress sheet 30 that are connected together in an overlapping arrangement. A cavity 50 is formed between the overlapping sheets 20, 30 and includes an opening 51 to receive a mattress (not illustrated in FIG. 1). The cover section 14 is attached to the mattress section 12 and provides for positioning over a user for warmth while sleeping. The mattress section 12 and the cover section 14 are connected together and include a one-piece unitary construction. This reduces the likelihood of a person using one or both of the sections 12, 14 as a weapon to injure themselves or another.

Figure 2:
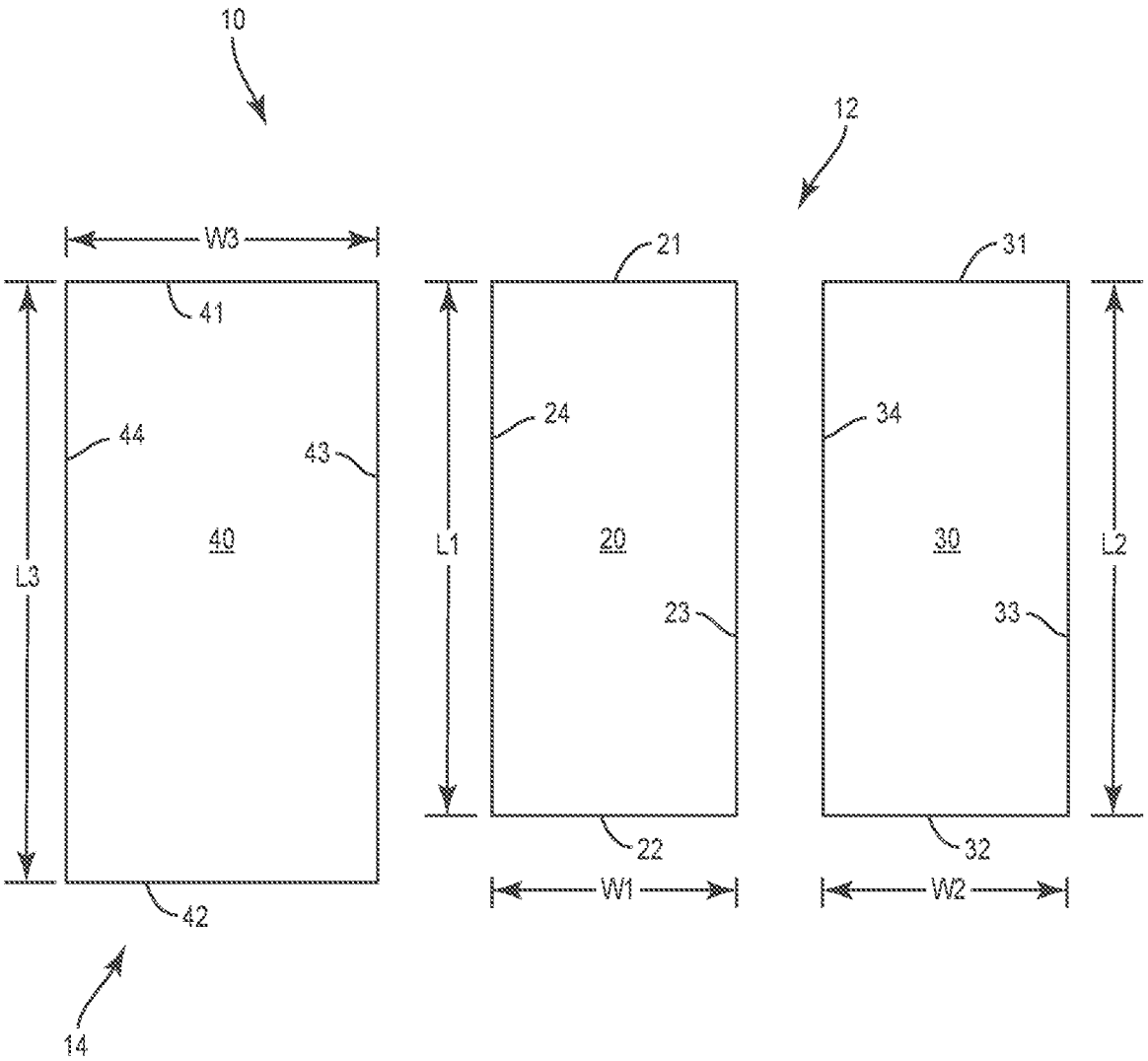
FIG. 2 is an exploded top view of a sheet assembly that includes a top mattress sheet, a bottom mattress sheet, and a cover sheet.

FIG. 2 illustrates an exploded view of the sheet assembly 10. The mattress section 12 is formed by the top and bottom mattress sheets 20, 30, and the cover section 14 is formed by a cover sheet 40. The top and bottom mattress sheets 20, 30 include respectively first ends 21, 31, second ends 22, 32, and lateral sides 23, 24, 33, 34. The top mattress sheet 20 includes a length L1 measured between the ends 21, 31, and a width W1 measured between the lateral sides 23, 24. The bottom mattress sheet 30 includes a length L2 and a width W2. In one example, the top and bottom mattress sheets 20, 30 include the same shape and size. In other examples, the top and bottom mattress sheets 20, 30 include different shapes and/or sizes.

The top and bottom mattress sheets 20, 30 are connected together at seams 61, 62, 63 as illustrated in FIG. 1. Seam 61 connects together the lateral sides 23, 33. Seam 62 connects together the first ends 21, 31. Seam 63 connects together the lateral sides 24, 34. The seams 61, 62, 63 can extend along the entire edges, or one or more limited sections of the edges.

The seams 61, 62, 63 connect the top and bottom mattress sheets 20, 30 together along three of the sides. As illustrated in FIG. 1, the fourth side formed at second ends 22, 32 includes an opening 51 that leads into the cavity 50. The opening 51 provides for inserting and removing the mattress. In one example, the entire fourth side is open to facilitate insertion and removal of the mattress into and out of the cavity 50. In other examples, one or more sections of the fourth side are seamed with the opening 51 extending along a limited portion of the fourth side.

The cover sheet 40 includes a length L3 measured between first and second ends 41, 42 and a width W3 measured between opposing lateral sides 43, 44. The cover sheet 40 can include various shapes and sizes. In one example, the cover sheet 40 includes a larger length and/or width than the top and bottom mattress sheets 20, 30. This provides for the cover sheet 40 to fully extend over a person who is laying on the mattress section 12.

In one example, the width W3 of the cover sheet 40 is larger than the widths W1, W2 of the top and bottom mattress sheets 20, 30. The length L3 is the same of the lengths L1, L2 of the top and bottom mattress sheets 20, 30, but the cover sheet 40 is offset along the lengths L1, L2. That is, the first end 41 is positioned downward from the aligned first ends 21, 31 of the top and bottom mattress sheets 20, 30. This provides for the head of a person to be exposed when they are laying on the mattress section 12 with their head at the first ends 21, 31. The offset positioning also includes the second end 42 offset outward beyond the second ends 22, 32. This offset provides for the person's feet to be covered by the cover sheet 40.

In one example, the lengths L1, L2, and L3 are all equal. The cover sheet 40 is shifted relative to the mattress sheets 20, 30 such that a person's head is exposed when they are using the assembly 10. In one example, this shifting provides for the first end 41 to be longitudinally offset and away from first ends 21, 31 (see FIG. 4).

The cover sheet 40 that forms the cover section 14 is attached to the mattress section 12 at the seam 63. That is, the seam 63 connects together each of the lateral sides 24, 34, and 43. This connection prevents the cover sheet 40 from being removed from the mattress section 12 and used individually to craft a weapon. The integrally formed sheet assembly 10 that includes both the mattress section 12 and the cover section 14 is more difficult to craft into a weapon due to the larger size and/or bulk of the components. Thus, a person may not be able to craft an elongated member that can be used to injure themselves or another. Further, the single seam 63 that connects together the top and bottom mattress sheets 20, 30 and the cover sheet 40 can facilitate manufacturing of the sheet assembly 10.

The sheet assembly 10 can be constructed from a variety of different materials. Examples of materials include but are not limited to polyester, polypropylene, modacrylic, cotton, wool, and nylon. The sheet assembly 10 can also include various structures, including but not limited to woven, nonwoven, knit, felt, batting, foam, and film. One specific design includes a 650 denier polyester with a 10 oz. polyester batting. In one example, the cover section 14 is constructed from a heavier material than the mattress section 12. The heavier cover section 14 is an individual element as opposed to the dual-ply mattress section 12. The heaver cover section 14 prevents and/or reduces this section 14 from being crafted as a weapon. In another example, the top and bottom mattress sheets 20, 30 are made from the same materials. In another example, the sheets 20, 30 are made from different materials.

Figure 3:
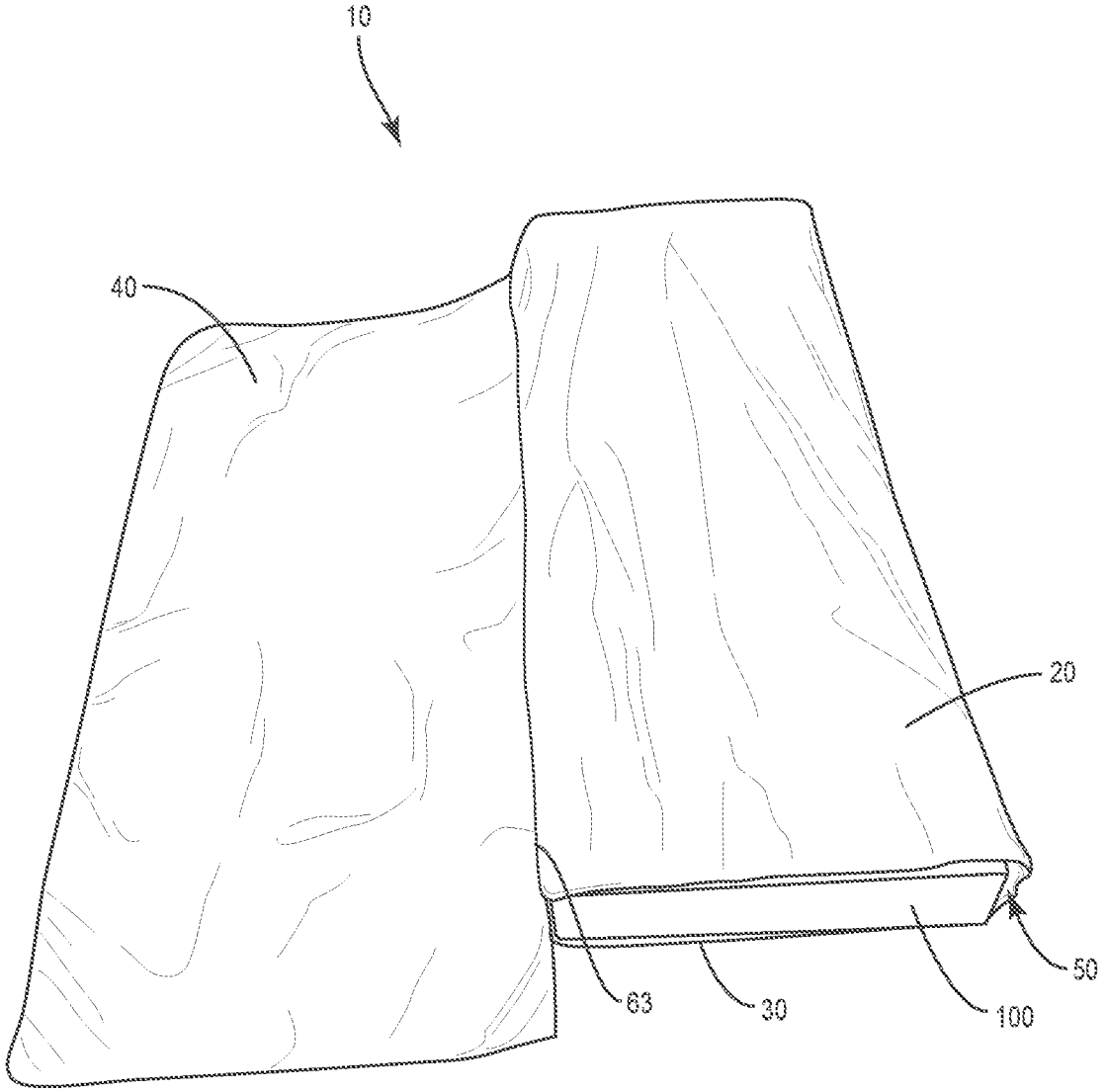
FIG. 3 is a perspective view of a sheet assembly in an open configuration and positioned on a mattress.

FIG. 3 illustrates the sheet assembly 10 in an open orientation. A mattress 100 is positioned in the cavity 50 formed between the top and bottom mattress sheets 20, 30. The length of the top and bottom mattress sheets 20, 30 provides for the mattress 100 to be positioned in the cavity 50. In one example, the cavity 50 is sized to completely contain the mattress 100. In another example, the cavity 50 is sized for just a limited section of the mattress 100 to extend outward beyond the opening 51.

As further illustrated in FIG. 3, the cover sheet 40, the top mattress sheet 20, and the bottom mattress sheet 30 are each connected together at the seam 63. The seam 63 extends along the lateral sides 24, 34, 43 of the sheets 20, 30, 40. The seam 63 is further positioned along a lateral edge of the mattress 100. This positioning spaces the seam 63 away from where the person contacts against the mattress section 12 which may provide for additional comfort. In one example, the seam 63 is positioned along a lateral side of the mattress 100.

Figure 4:
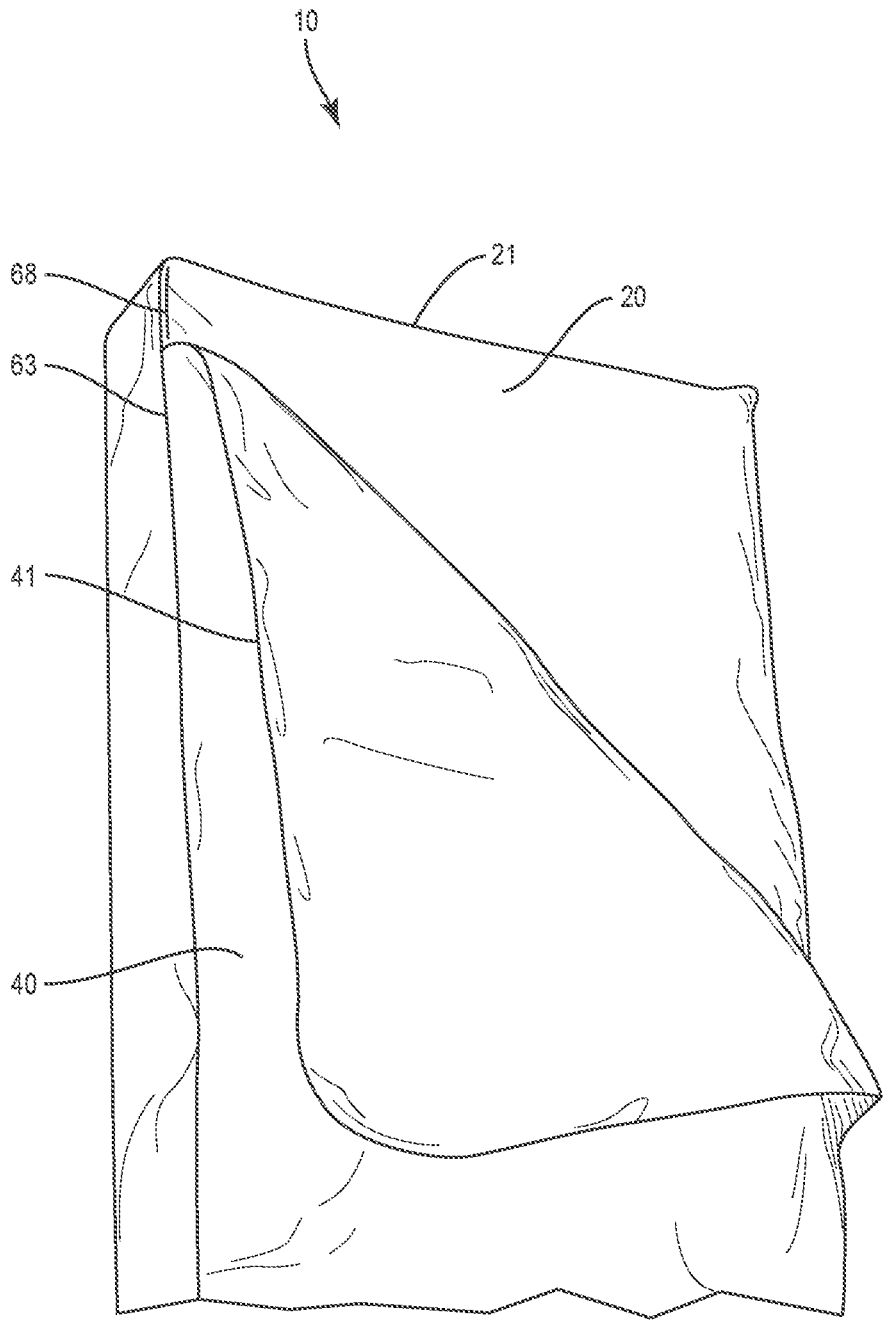
FIG. 4 is a partial perspective view of a cover sheet in a closed orientation and with a first end partially folded back.

FIG. 4 illustrates the cover sheet 40 in a closed orientation that extends over the top mattress sheet 20. The cover sheet 40 can be folded back away from the first end 21 of the top mattress sheet 20 as desired by the person. The cover sheet 40 is sized to extend completely across the top mattress sheet 20. The cover sheet 40 is offset relative to the top mattress sheet 20 such that the first end 41 of the cover sheet 40 is positioned below the first end 21 of the top mattress sheet 20. The first ends 21, 31 of the top and bottom mattress sheets 20, 30 are attached together to form a closed end such that a head of the person does not directly contact the mattress 100.

In one example as illustrated in FIG. 4, the cover sheet 40 is shifted relative to the sheets 20, 30 of the mattress section 12. A section 68 is formed along the sheets 20, 30 that are not overlapped by the cover sheet 40. In one example, this section 68 includes additional reinforcement, such as one or more additional seams or stitching, to ensure that the sheets 20, 30 remain attached together.

In one or more examples, additional reinforcement is provided along one or more of the sheets 20, 30, 40. In one example, the additional reinforcement is positioned along the first ends 21, 31, 41 and/or second ends 22, 32, 42 where each is connected together. In one example, the additional reinforcement is additional stitching or additional seams.

Figure 5:
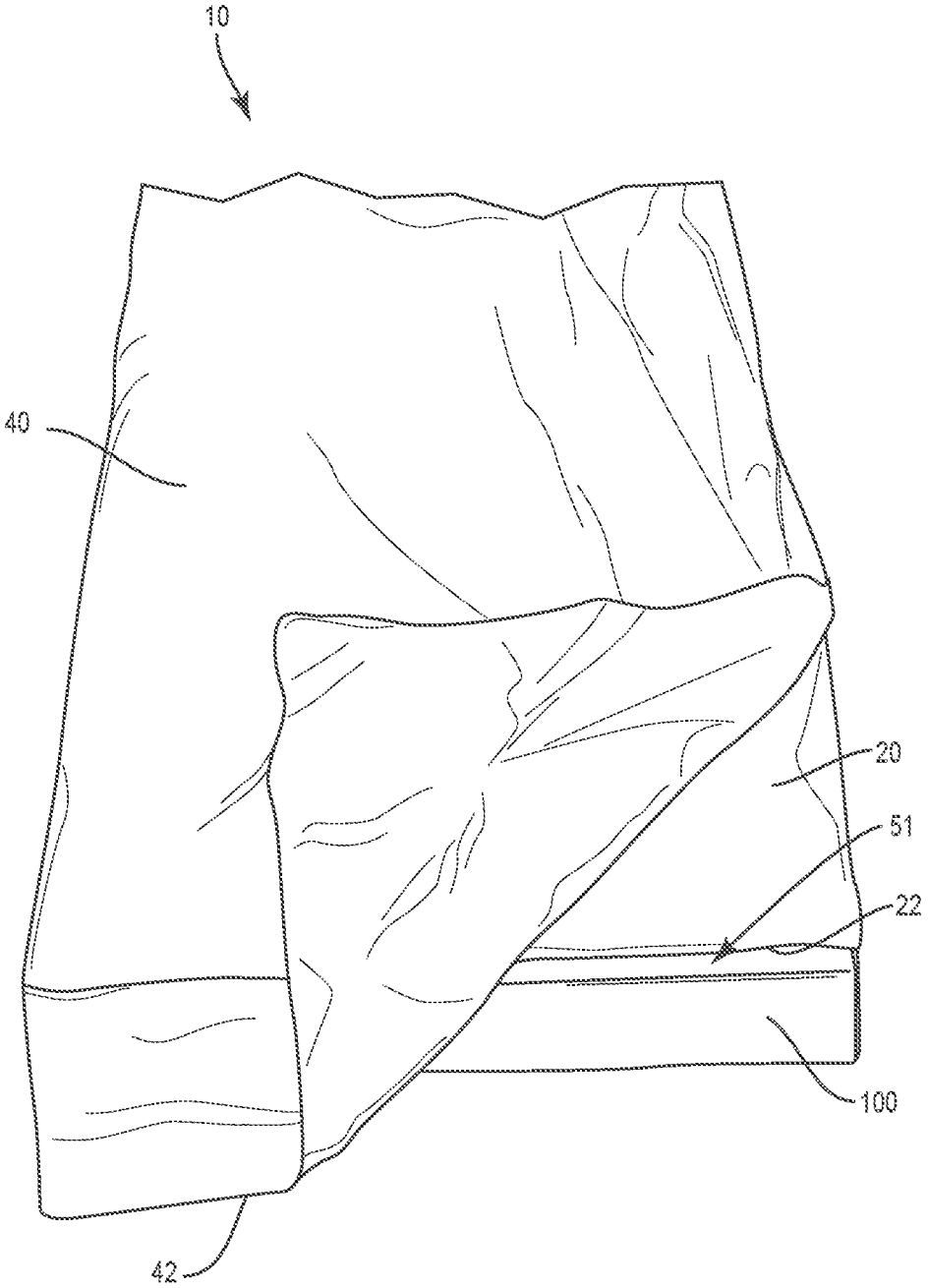
FIG. 5 is a partial perspective view of a second end of a cover sheet partially folded back to expose an underlying top mattress sheet and a mattress.

FIG. 5 illustrates a bottom end of the sheet assembly 10. In this example, the mattress 100 extends outward a limited amount from the opening 51. During use, the person's feet are positioned at this bottom end. The cover sheet 40 is offset relative to the top mattress sheet 20 with the second end 42 positioned outward beyond the second end 22. This offset provides for the cover sheet 40 to extend over the feet of the person.

Figure 6:
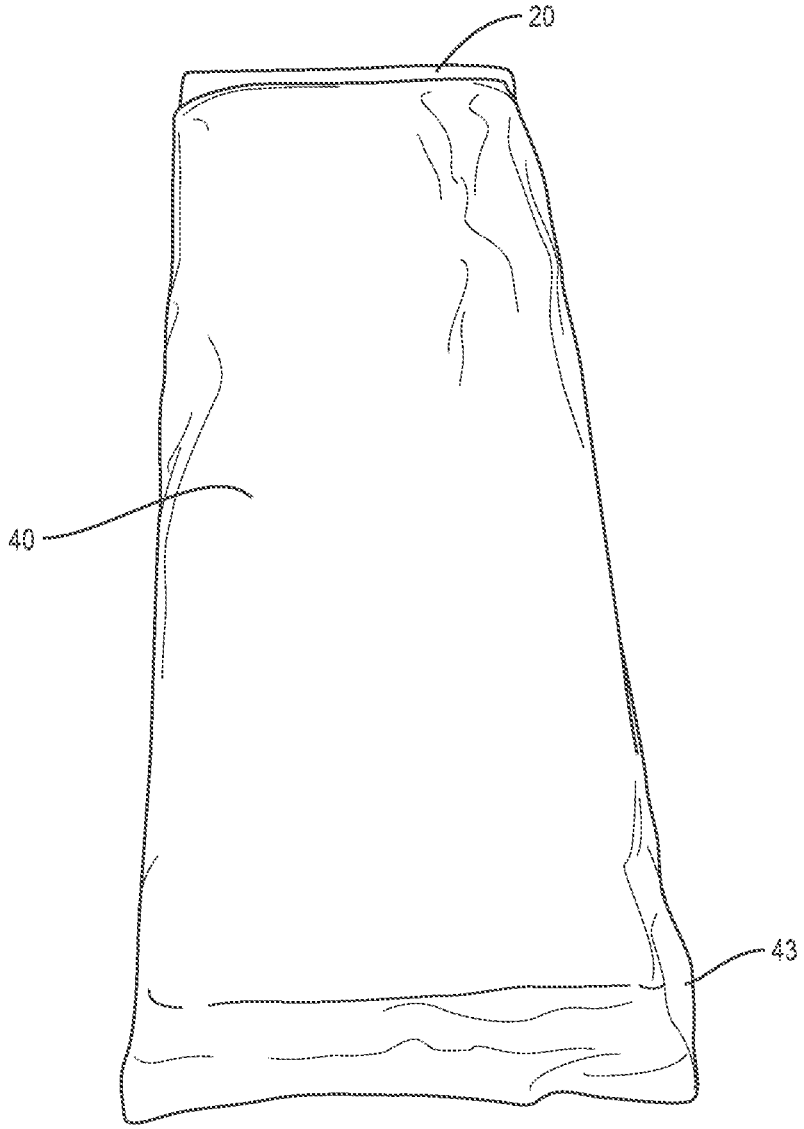
FIG. 6 is a perspective view of a sheet assembly in a closed orientation.

FIG. 6 illustrates the sheet assembly 10 in a closed orientation. The cover sheet 40 includes a greater width than the top mattress sheet 20 with the lateral side 43 positioned outward beyond the lateral side 23 (not illustrated in FIG. 6).

Figure 7:
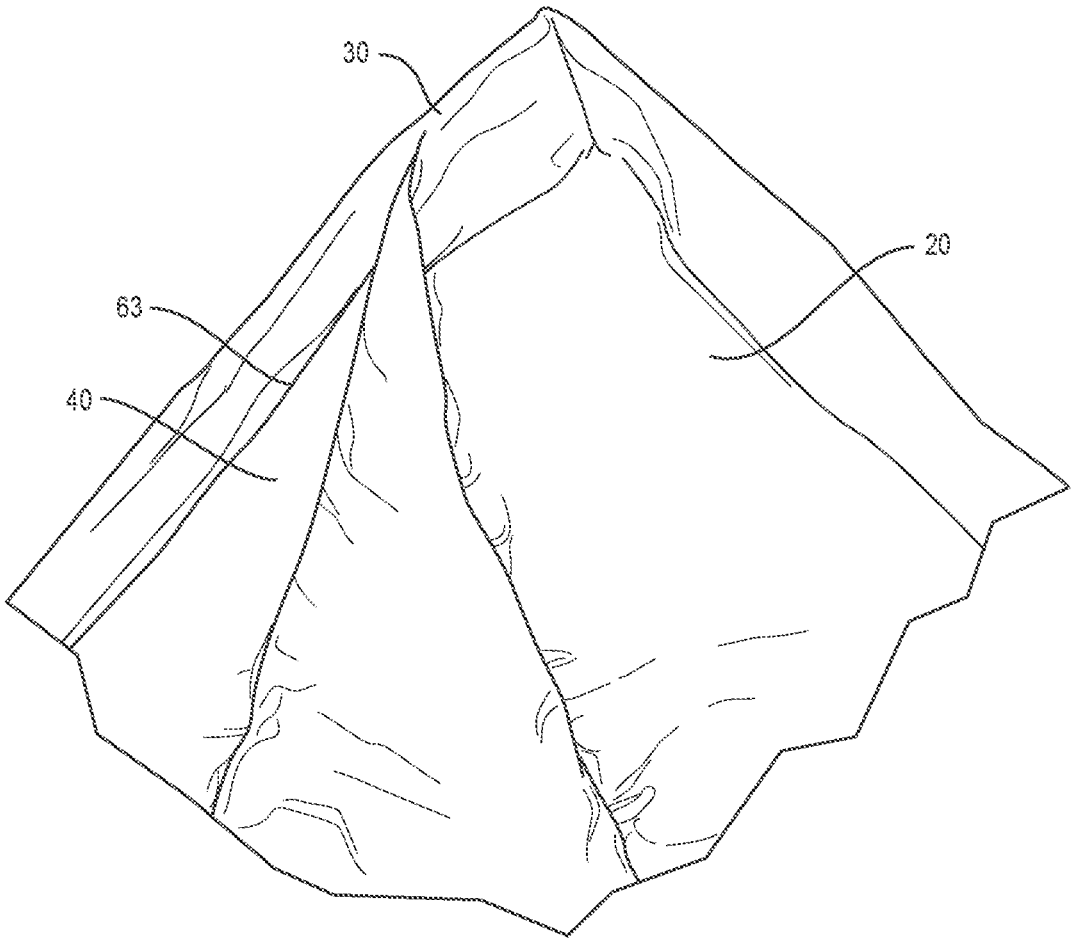
FIG. 7 is a partial perspective view of a cover sheet in a closed orientation with a first end partially folded back.

FIG. 7 illustrates the cover sheet 40 in a closed orientation. The first end 41 is partially folded back to expose the underlying top mattress sheet 20.

In use, a mattress 100 is inserted through the opening 51 and into the cavity 50 between the top and bottom mattress sheets 20, 30. The sheet assembly 10 is positioned with the seam 63 extending along one edge of the mattress 100. In the open orientation, the cover sheet 40 is positioned outward away from the top and bottom mattress sheets 20, 30. In a first closed orientation, the mattress 100 is positioned with the top mattress sheet 20 facing upward. The person can lay on the top mattress sheet 20 and the cover sheet 40 folded over the person. In a second closed orientation, the mattress 100 is positioned with the bottom mattress sheet 30 facing upward. The person can lay on the bottom mattress sheet 30 and the cover sheet 40 is folded over onto the person. Positioning the seam 63 along the edge of the mattress 100 provides for the sheet assembly 10 to be used in either closed orientation.

In one example, the top mattress sheet 20 and the bottom mattress sheet 30 are constructed from different materials. The person using the sheet assembly 10 can select which of the two materials they prefer and position that applicable sheet 20, 30 upward.

Figure 8:
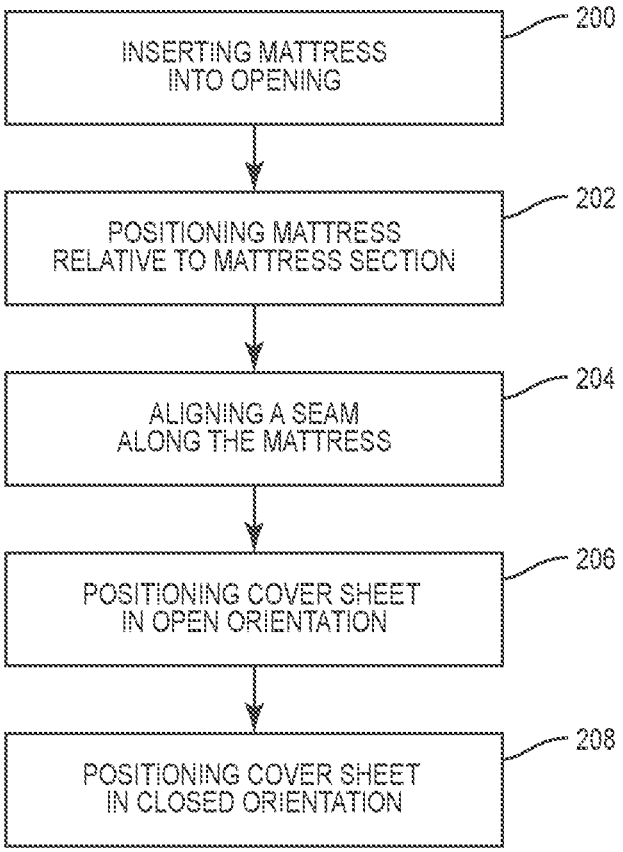
FIG. 8 illustrates a flowchart of a method of using a sheet assembly with a mattress in a correctional institution.

FIG. 8 illustrates on method of using a sheet assembly 10 with a mattress 100 in a correctional institution. Initially, the sheet assembly 10 is positioned for the opening 51 to be accessible. This provides for inserting the mattress into the opening 51 (block 200). The mattress 100 is positioned within a cavity 50 in the mattress section 12. The insertion includes positioning a top mattress sheet 20 along one face of the mattress 100 and a bottom mattress sheet 30 along an opposing second face of the mattress 100 (block 202). This positioning also includes aligning a seam 63 along an edge of the mattress 100 that is positioned between the faces (block 204). The sheet assembly 10 is positioned with a cover sheet 40 that is attached to the mattress section 12 at the seam 63 in an open orientation that is away from the mattress 100 in a non-overlapping arrangement (block 206). After the person lays down on the mattress section 12, the cover sheet 40 can be positioned in a closed orientation that overlaps the mattress 100 (block 208).

Figure 9:
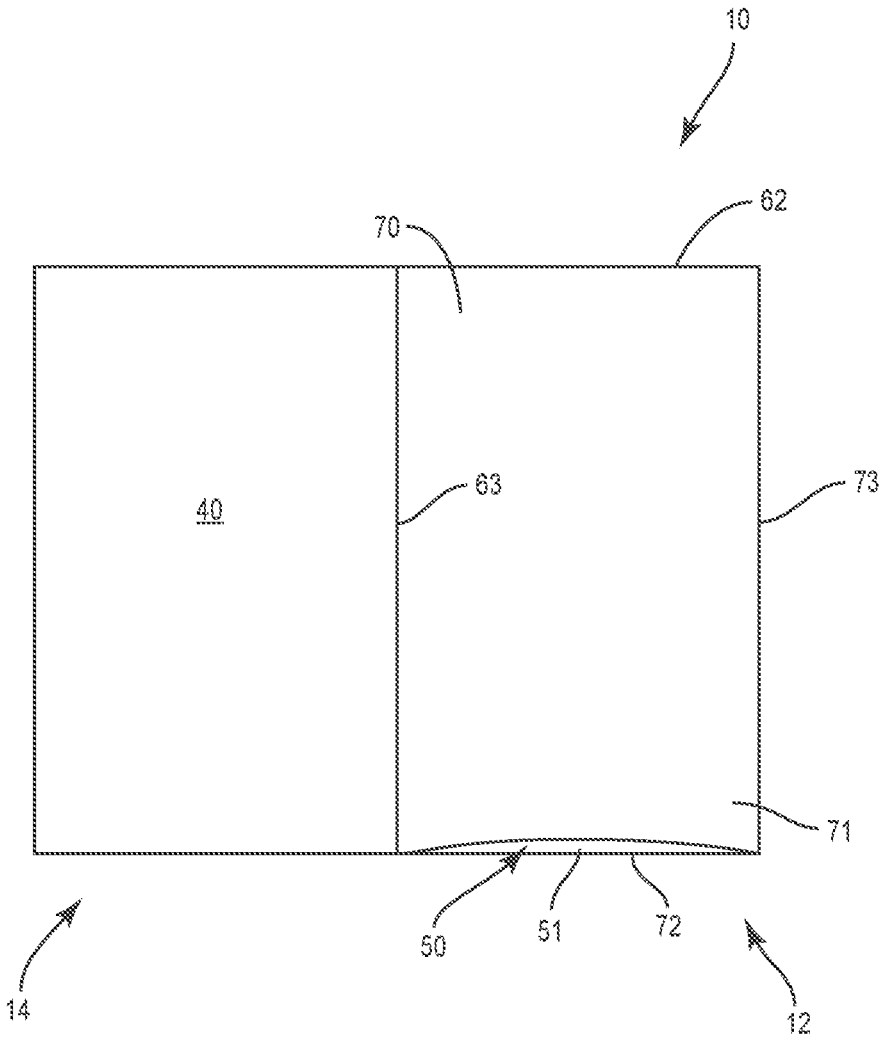
FIG. 9 schematic diagram of a sheet assembly in an open orientation.

In one example, the mattress section 12 is formed by two separate sheets including a top mattress sheet 20 and a bottom mattress sheet 30. The two separate sheets 20, 30 are connected together along one or more seams. In another example as illustrated in FIG. 9, the mattress section 12 is formed by a single folded sheet 70. The folded sheet 70 includes a top section 71 and a bottom section 72 that are in an overlapping orientation with an intermediate fold 73. In one example, the top and bottom sections 71, 72 include the same shape and size. In another example, the top and bottom sections 71, 72 include different shapes and/or sizes.

In one example, the edges of the top and bottom sections 71, 72 are attached together at the seam 63. The seam 63 also attaches the cover sheet 40. The fold 73 is positioned along an opposing side of the mattress section 12 that is away from the seam 63. A seam 62 can connect together the edges of the top and bottom sections 71, 72 that are opposite from the opening 51. In one example, the seam 62 and seam 63 are separate. In another example, seams 62 and 63 are formed by a single seam.

In a similar example, the folded edge of the mattress section 12 is attached to the cover sheet 40 at the seam 63. The open edges opposite the fold 73 are positioned away from the seam 63 and connected together with a separate seam. In yet another example, the fold line forms the end of the mattress section 12 opposite from the opening 51.

In the various examples, the mattress section 12 can include one or more openings 51 that lead into the cavity 50. In one example as illustrated in FIGS. 1 and 9, a single opening 51 leads into the cavity 50. In another example, a pair of openings 51 lead into the cavity 50. A first opening 51 is positioned at the first ends of the top and bottom sections and a second opening 51 is positioned at the second ends. In one example in which the mattress section is formed by a single folded sheet 70, a single seam 63 connects together the opposing lateral sides and the first and second ends each include openings 51. In one example, the single seam 63 connects together the opposing lateral sides of the single sheet 70 and also the cover sheet 40. In one example, the entire sheet assembly 10 includes just the single seam 63 that forms the different components of the assembly 10 into a single unitary construction.

In one example, the person being held at the correctional facility (e.g., the inmate) can be given the sheet assembly 10 and instructed to place it on the mattress 100. In another example, a person working at the correctional facility can place the sheet assembly 10 on the mattress 100 and provide it to the person for use.

In the examples described above, the cover sheet 40 is attached to the mattress section 12 along a lateral side. In other examples, the cover sheet 40 is attached to the mattress section 12 along one of the ends. In one specific example, the cover sheet 40 is attached to the mattress section 12 long the first ends 21, 31 with a single seam connecting all three sheets 20, 30, 40.

The sheet assembly 10 integrates multiple different components into a single component. Instead of having two or three separate pieces for their bedroll, the person has a single assembly 10. In an institutional facility, this reduction in the number of components provided to a person can be helpful in monitoring the person and ensuring the person is not using the components in a potentially harmful and/or improper manner. Further, this reduces the number of different components that are purchased and monitored by the facility.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are second ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive.

What is claimed is:

1. A sheet assembly for use with a mattress in a correctional institution, the sheet assembly comprising:

a mattress section comprising a pair of overlapping sheets that are seamed together along at least two sides and that form an interior space sized to contain the mattress, the mattress section comprising a length measured between a head end at a head of the mattress section and a foot end at a foot of the mattress section;

a cover section comprising a single sheet, the cover section comprising a top end that is offset from the head end of the mattress section;

a seam that extends along a common side of each of the mattress section and the cover section, the seam connects together the mattress section and the cover section;

the cover section is movable relative to the mattress section between an open orientation away from the mattress section and a closed orientation that overlaps with the mattress section; and the cover section extends along the length of the mattress section and in the closed orientation the top end of the cover section is spaced away from the head end of the mattress section for a head of a person to be exposed when laying on the mattress section and a bottom end of the cover section is spaced outward beyond the foot end of the mattress section away from the head end of the mattress section.

2. The sheet assembly of claim 1, wherein the mattress section comprises a single member that is folded and that forms the pair of overlapping sheets.

3. The sheet assembly of claim 2, wherein the single member comprises a fold edge that extends along a first lateral side of the mattress section and a pair of exposed ends that extend along an opposing second lateral side of the mattress section and that are secured together at the seam.

4. The sheet assembly of claim 3, wherein the single member further comprises first and second ends that extend between the first and second lateral sides with the first and second ends comprising openings that are in communication with the interior space.

5. The sheet assembly of claim 1, wherein the cover section comprises a greater length than the mattress section.

6. The sheet assembly of claim 1, wherein the overlapping sheets of the mattress section are connected together along first and second lateral sides and one end side with the seam.

7. The sheet assembly of claim 1, wherein the mattress section is constructed from different material than the cover section.

8. The sheet assembly of claim 1, wherein the seam is a first seam and further comprising a second seam that connects together one end of the mattress section.

9. The sheet assembly of claim 1, wherein the mattress section is connected to the cover section just along the common side of each of the mattress section and the cover section.

10. A sheet assembly for use with a mattress in a correctional institution, the sheet assembly comprising:

a top mattress sheet and a bottom mattress sheet that are connected together with seams in an overlapping arrangement and that form an interior space sized to receive the mattress, each of the top and bottom mattress sheets comprising first and second lateral sides and first and second ends, the top and bottom mattress sheets comprising a length measured between the first and second ends;

a cover sheet attached to each of the top mattress sheet and the bottom mattress sheet along the first lateral side; and the cover sheet being offset along the first lateral side from the top and bottom mattress sheets for a top end of the cover sheet to be positioned along the length below top ends of the top and bottom mattress sheets and a bottom end of the cover sheet to be positioned outward beyond bottom ends of the top and bottom mattress sheets that is away from the top ends of the top and bottom mattress sheets.

11. The sheet assembly of claim 10, wherein the top mattress sheet and the bottom mattress sheet are constructed from a single sheet and comprise a fold line along the second lateral side.

12. The sheet assembly of claim 11, further comprising openings positioned between each of the first and second ends of the top and bottom mattress sheets, the openings are in communication with the interior space.

13. The sheet assembly of claim 10, wherein the cover sheet comprises a greater length than each of the top and bottom mattress sheets.

14. The sheet assembly of claim 10, wherein the second ends of each of the top and bottom mattress sheets are connected together.

15. The sheet assembly of claim 10, wherein each of the top and bottom mattress sheets and the cover sheet comprise rectangular shapes.

16. The sheet assembly of claim 10, wherein the top and bottom mattress sheets and the cover sheet are connected together along the first lateral sides with a single seam.

17. The sheet assembly of claim 16, wherein the single seam is positioned away from the first and second ends of the top mattress sheet and the bottom mattress sheet.

18. The sheet assembly of claim 10, wherein the cover sheet is connected to the top mattress sheet and the bottom mattress sheet along just the first lateral side.

* * * * *